United States Patent [19]

Kittner et al.

[11] Patent Number: 4,731,962

[45] Date of Patent: Mar. 22, 1988

[54] COMPRESSION-TENSION STRUT-CORD UNITS FOR TENSILE-INTEGRITY STRUCTURES

[75] Inventors: Cary Kittner; Stuart R. Quimby, both of Barrytown, N.Y.

[73] Assignee: Tensegrity Systems Corporation, Barrytown, N.Y.

[21] Appl. No.: 945,808

[22] Filed: Dec. 24, 1986

[51] Int. Cl.[4] ..... A63H 33/00; E04B 1/32; E04H 12/18

[52] U.S. Cl. ..... 52/81; 52/645; 52/646; 52/720; 52/DIG. 10; 135/106; 446/107; 446/119

[58] Field of Search ..... 52/81, 645, 646, 720, 52/DIG. 10; 135/106; 403/206; 124/23 R; 446/107, 119, 478

[56] References Cited

U.S. PATENT DOCUMENTS

| | | | |
|---|---|---|---|
| 1,745,922 | 2/1930 | Flenner | 403/206 |
| 2,758,587 | 8/1956 | Verreau | 124/23 R |
| 3,063,521 | 11/1962 | Fuller | 52/11 X |
| 3,289,353 | 12/1966 | Van Eden | 52/291 X |
| 3,347,242 | 10/1967 | Barker | 52/291 X |
| 3,695,617 | 10/1972 | Mogilner et al. | 52/81 X |
| 3,817,010 | 6/1974 | Stegmuller | 52/291 X |
| 4,148,520 | 4/1979 | Miller | 52/648 X |
| 4,277,922 | 7/1981 | McAllister | 52/81 |
| 4,614,502 | 9/1986 | Nelson | 52/648 X |

FOREIGN PATENT DOCUMENTS

| | | | |
|---|---|---|---|
| 1519240 | 2/1968 | France | 52/81 |
| 586247 | 12/1977 | U.S.S.R. | 52/81 |

OTHER PUBLICATIONS

Tensegrity: Introductory Theory and Model Construction, Robert Grip, Copyright 1978, 18 pages.

*Primary Examiner*—Alfred C. Perham
*Attorney, Agent, or Firm*—Charles J. Brown

[57] ABSTRACT

A compression-tension unit for use in a tensile-integrity structure wherein end portions of an elastic cord are passed through slots in the opposite ends of a strut with a stretched intermediate cord portion therebetween, and opposite tips of the cord are held in lateral holes in the strut end portions adjacent the slots, there being a choice of such lateral holes spaced longitudinally apart at each strut end portion so that the degree of stretch in the intermediate cord portion can be varied.

12 Claims, 6 Drawing Figures

COMPRESSION-TENSION STRUT-CORD UNITS FOR TENSILE-INTEGRITY STRUCTURES

BACKGROUND OF THE INVENTION

Struts and elastic cords have long been utilized in tensile-integrity structures, or tensegrities as they are called, to provide the discontinuous compression and continuous tension members characteristic of such structures. Buckminster Fuller's U.S. Pat. No. 3,063,521 is an early explanation of such strut-cord units. Caps are illustrated on the slotted ends of the struts in that disclosure and another form of caps is shown in U.S. Pat. No. 4,148,520.

Some designs of strut-cord units are adapted particularly for model kits in which they can be assembled into tensegrities of various sizes and designs. A full discussion of one form of such strut-cord units for model kits is found in "Tensegrity: Introductory Theory and Model Construction" by Robert Gripp, copyrighted in 1978 and available from the Buckminster Fuller Institute in Philadelphia, Pa., U.S.A. The struts described in that publication are simple dowels with longitudinal slots cut into their respective ends and the associated cords are ordinary closed-loop rubber bands which extend with double runs between the slots. It is recognized that strut-cord units in model kits may be designed to construct various sizes of tensegrities and therefore U.S. Pat. No. 4,614,502 proposes that the struts be telescopic so that their lengths can be varied.

It is a primary purpose of the present invention to provide a strut-cord unit for tensegrities, especially for model kits, which allows for variations in construction by varying the stretch of the elastic cord while employing struts of a fixed length. It is a further object of the invention to avoid the double run aspect of closed-loop rubber bands by providing single-strand elastic cords. It is also an object of the invention to equip the struts with end caps which not only improve the appearance of the assembly but also serve to hold in place the cord portions passed through the slots in the ends of the struts.

SUMMARY OF THE INVENTION

The invention provides a compression-tension unit for use in a tensile-integrity struture or in combination with similar compression-tension units in such a structure. Each unit comprises an elongated rigid strut for bearing compression and formed with an end slot laterally through and longitudinally into each end of the strut. The strut is also formed with at least one lateral hole extending into each strut end portion. An elastic cord is provided for bearing tension and has tips adapted to be held within the lateral holes at the respective strut end portions. Adjoining cord portions adjacent the tips are fitted through the respective adjacent end slots and with a stretched intermediate portion therebetween.

In a preferred form of the invention a plurality of lateral holes are spaced longitudinally apart at each strut end portion to permit variations in the degree to which the elastic cord intermediate portion is stretched. Also the elastic cord tips are preferably substantially rigid and the lateral holes in which the tips are adapted to be held extend through the strut end portions. A pair of removable caps may be provided which are adapted to be force-fitted over the respective strut ends to partially enclose the end slots. It is preferred that the end slots be aligned and the lateral holes be parallel to one another and to the end slots.

DESCRIPTION OF PREFERRED EMBODIMENT

Figures 1, 2, 3, 4:
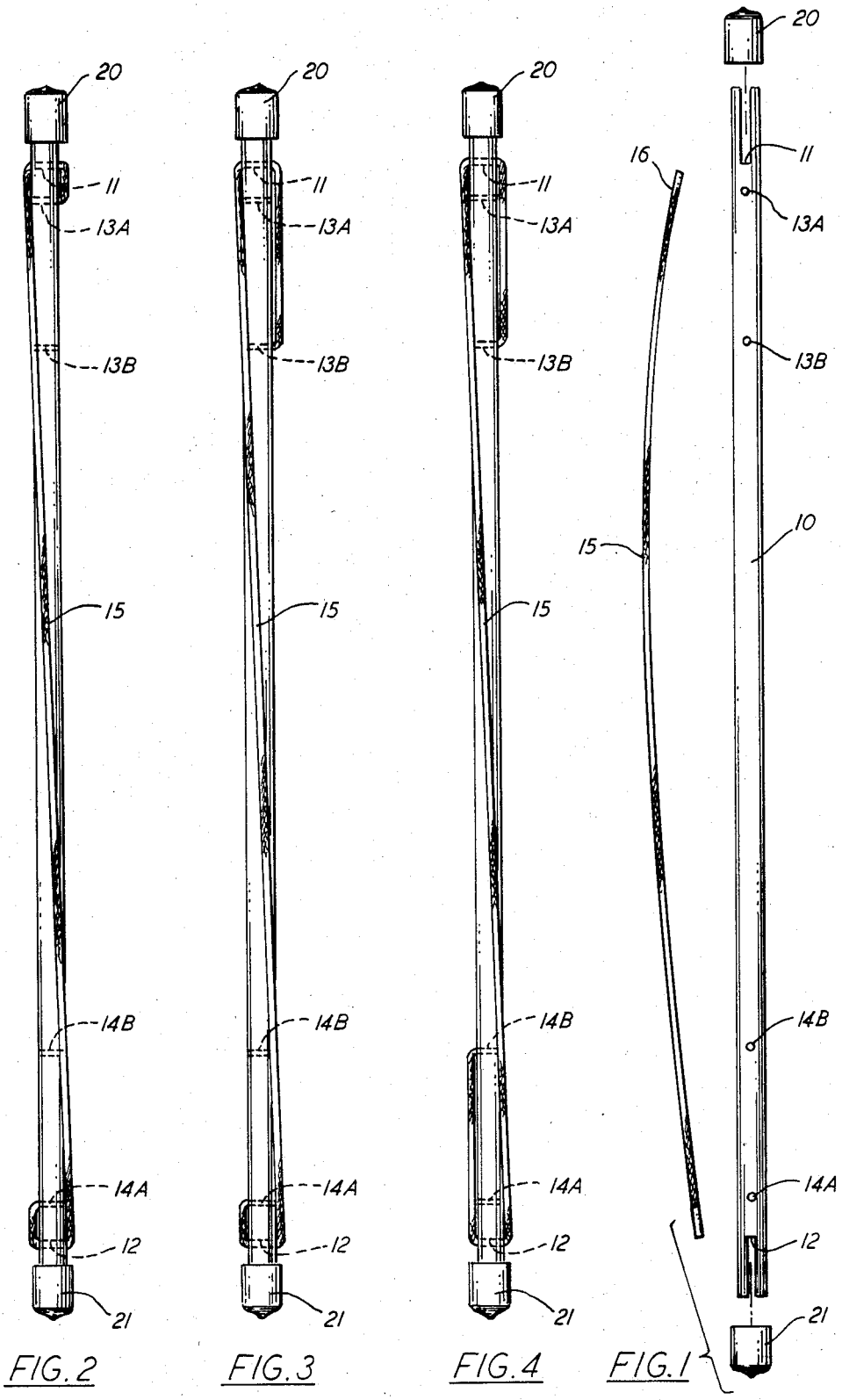
FIG. 1 is an exploded view of the elements of one strut-cord unit according to the invention.
FIG. 2 is an elevation of the strut-cord unit of the invention with selected lateral holes in the struts utilized for minimum cord tension.
FIG. 3 is a similar elevation with selected lateral holes utilized for intermediate cord tension.
FIG. 4 is a similar elevation with selected lateral holes utilized for still more cord tension.

Turning first to FIG. 1, the elements of one compression-tension unit according to the invention are all shown in this exploded view. They include an elongated rigid strut 10 of circular cross section which may be a wooden dowel. End slots 11 and 12 extend laterally through and longitudinally into the respective ends of the strut 10. The slots 11 and 12 are aligned, which is to say when the strut is viewed on-end the two end slots are seen to be in the same plane and not crossing one another. At the end portion of the strut 10 formed with the slot 11 a pair of longitudinally spaced holes 13A and 13B extend through the strut. These holes are parallel to one another and to the end slot 11. At the opposite end portion of the strut 10 adjacent the end slot 12 are a similar pair of longitudinally spaced holes 14A and 14B which are also parallel to one another and to the end slot 12.

An elastic tension-bearing cord 15 is provided which has substantially rigid tips 16 and 17 similar to shoelace tips. In the relaxed state of the elastic cord 15 shown in FIG. 1 its length is less than the length of the strut 10.

A pair of removable plastic caps 20 and 21 are provided which can be force-fitted over the respective strut ends to partially enclose the end slots 11 and 12.

The assembly of these parts of the compression-tension unit of the invention will first be described in reference to FIG. 2. The tip 16 of the cord 15 is first inserted into the hole 13A nearest the slot 11. The cord 15 is then looped around the adjacent end of the strut 10 and pulled through the slot 11. The cord is then stretched down the length of the strut 10 and halfway around it. The opposite end of the cord is then pulled back through the slot 12 and the tip 17 of the cord is inserted in the hole 14A nearest the slot 12. The tips 16 and 17 are thus facing in opposite directions in their respective holes 13A and 14A. The purpose in attaching the cord 15 diagonally from one end to the other on each strut 10 is that when building a compression-tension structure it is important to keep that elevation of the unit seen in FIG. 2 facing upwardly so that the cord is free to stretch out and away from the structure being assembled. The elastic cord should be pulled tight at each end to eliminate any slack which may exist between the tips 16 and 17 and the short length of the cord extending to the respective adjacent slots 11 and 12. The caps 20 and 21 are shown fitted in place in FIG. 2 though in actual practice they are not applied until the ends of a given unit are attached to like units as is described hereinafter.

It will be recognized that a minimum amount of tension is applied to the elastic cord 15 in the assembly of FIG. 2 when the cord tips 16 and 17 are placed in the holes 13A and 14A nearest their respective slots. This minimum initial tension on the cord permits it to stretch to a maximum, which is appropriate to a relatively simple tensegrity structure such as a tetrahedron. In FIG. 3 the tip 16 of the cord 15 is inserted in the hole 13B remote from the associated slot 11 while the other tip 17 remains in place in the hole 14A. It will be seen that this somewhat increases the initial tension on the cord 15 an permits less additional stretching which is a condition appropriate to structures of intermediate size such as an octahedron. In FIG. 4 it will be seen that the tip 16 remains in the hole 13B whereas the opposite tip 17 is now inserted in the hole 14B remote from its associated slot 12. This produces the still more initial tension on the cord 15 thus allowing for the least amount of additional stretching, which is a situation best suited for construction of a more complicated design such as an icosahedron. Even greater initial tension on the cord can be achieved by an arrangement not shown in the drawings, namely similar to the FIG. 3 arrangement but where the tip 13B is brought downwardly along the strut 15 and inserted in the hole 14B.

Figure 5:
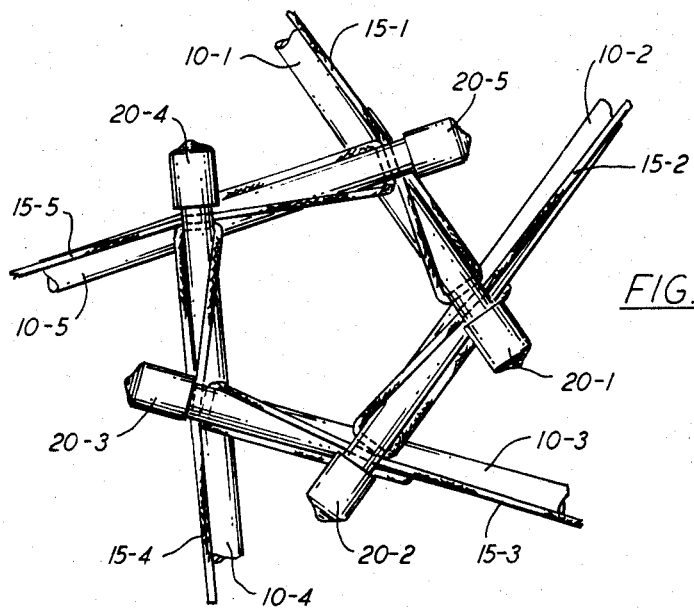
FIG. 5 is an enlarged fragmentary view of the end portions of five strut-cord units of the invention joined together into a pentagonal vertex.

Turning now to FIG. 5, five compression-tension units according to the invention are interconnected to form a vertex as would be typical of an icosahedron structure. Only the struts and cords of each of the five units have been given reference numerals in FIG. 5, and for clarity these are designated as strut 10 and cord 15 as previously referred to with a suffix 1 to 5 added for each unit in the vertex. It will be seen that the end slot of strut 10-1 is fitted onto the next cord 15-2, the end slot of the strut 10-2 is fitted onto the next cord 15-3, the end slot of the strut 10-3 is fitted onto the next cord 15-4, the end slot of the strut 10-4 is fitted onto the next cord 15-5, and the end slot of the strut 10-5 is fitted onto the cord 15-1 of the first strut 10-1. The respective caps 20-1, 20-2, 20-3, 20-4 and 20-5 are then applied as described previously. It will be apparent here that by wrapping each cord halfway around the length of its strut the cord is more accessible for connection with the end slot of the next strut.

Figure 6:
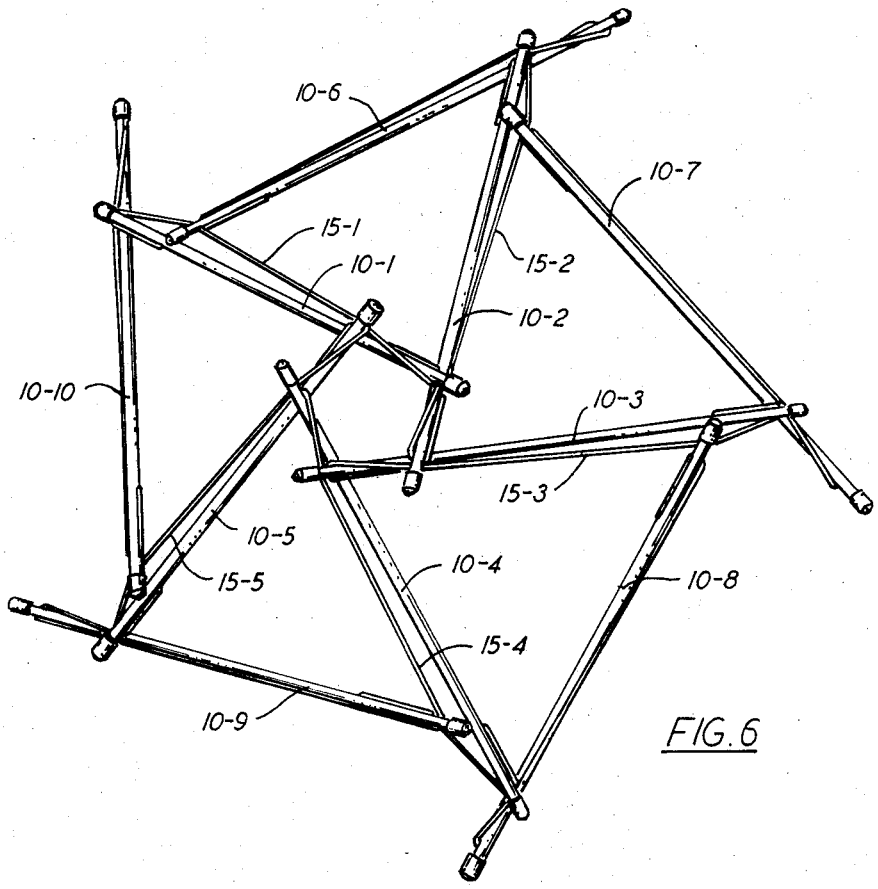
FIG. 6 illustrates the beginning of the construction of the tensegrity from the vertex of FIG. 5 showing the attachment of five more strut-cord units of the invention.

In FIG. 6 the next steps in the assembly of an icosahedron are shown with struts 10-6, 10-7, 10-8, 10-9 and 10-10 fitted respectively back onto the cords 15-1, 15-2, 15-3, 15-4 and 15-5. Consequently each of the cords 15-1, 15-2, 15-3, 15-4 and 15-5 now is held within the end slots of two additional struts at similar locations near the ends of each respective cord. The further steps in the assembly of the icosahedron are well known and need not be described here.

By varying the stretch of the elastic cord depending upon which combination of lateral holes is employed for the cord tips it is possible to effectively vary the length of the cord. This permits struts of a given length to be utilized in constructing various tensile-integrity structures from the same components. The double run characteristic of closed-loop rubber bands is avoided since the elastic cord is always in the form of a single strand.

We claim:

1. A compression tension unit for use in a tensile-integrity structure comprising (a) an elongated rigid strut for bearing compression formed with i. an end slot laterally through and longitudinally into each end of the strut, and ii. at least one lateral hole extending into each strut end portion; and (b) an elastic cord for bearing tension having substantially rigid tips sized for slip-fitting within and inserted into the lateral holes at the respective strut end portions with adjoining cord portions adjacent the tips fitted through the respective adjacent end slots and with a substantially stretched intermediate cord portion therebetween.

2. A compression-tension unit according to claim 1 wherein a plurality of lateral holes are spaced longitudinally apart at each strut end portion to permit variations in the degree to which the elastic cord intermediate portion is stretched.

3. A compression-tension unit according to claim 1 wherein the lateral holes in which the tips are adapted to be held extend through the strut end portions.

4. A compression-tension unit according to claim 1 further including a pair of removable caps which are adapted to be force-fitted over the respective strut ends to partially enclose the end slots.

5. A compression-tension unit according to claim 1 wherein the end slots are aligned and the lateral holes are parallel to one another and to the end slots.

6. A compression-tension unit in combination with like units in a tensile-integrity structure comprising (a) an elongated rigid compression-bearing strut formed with i. an end slot laterally through and longitudinally into each end of the strut, and ii. at least one lateral hole extending into each strut end portion; and (b) an elastic tension-bearing cord having substantially rigid tips sized for slip-fitting within and inserted into the lateral holes at the respective strut end portions with adjoining cord portions adjacent the tips fitted through the respective adjacent end slots and with a substantially stretched intermediate cord therebetween;

(c) each end slot of the strut also fitted about the elastic cord of a like unit.

7. A compression-tension unit according to claim 6 wherein a plurality of lateral holes are spaced longitudinally apart at each strut end portion to permit variations in the degree to which the elastic intermediate portion is stretched.

8. A compression-tension unit according to claim 6 wherein the lateral holes in which the tips are held extend through the strut end portions.

9. A compression-tension unit according to claim 6 further including a pair of removable caps force-fitted over the respective strut ends partially enclosing the end slots.

10. A compression-tension unit in combination with like units in a tensile-integrity structure comprising (a) an elongated rigid compression-bearing strut formed with i. aligned end slots laterally through and longitudinally into the respective ends of the strut, and ii. at least one lateral hole extending into each strut end portion with the respective holes being parallel to one another and to the end slots; and (b) an elastic tension-bearing cord having tips held within the lateral holes and facing in opposite directions at the respective strut end portions with adjoining cord portions adjacent the tips fitted through the respective adjacent end slots and with a stretched intermediate portion therebetween directed halfway around the strut;

(c) each end slot of the strut also fitted about the elastic cord of a like unit.

11. A compression-tension unit for use in a tensile-integrity structure comprising (a) an elongated rigid strut of circular cross-section for bearing compression formed with i. aligned end slots laterally through and longitudinally into respective ends of the strut, and ii. a pair of longitudinally spaced lateral holes through each strut end portion parallel to one another and to the end slots;

(b) an elastic cord for bearing tension having substantially rigid tips adapted to be held facing in opposite directions within a selected one of the lateral holes at the respective strut end portions with adjoining cord portions adjacent the tips fitted through the respective adjacent end slots and with a stretched intermediate portion therebetween directed halfway around the strut, the degree of stretch being determined by the selection of lateral holes in which the cord tips are held; and (c) a pair of removable caps adapted to be force-fitted over the respective strut ends to partially enclose the end slots.

12. A compression-tension unit in combination with like units in a tensile-integrity structure comprising (a) an elongated rigid compressing-bearing strut of circular cross-section formed with i. aligned end slots laterally through and longitudinally into respective ends of the strut, and ii. a pair of longitudinally spaced lateral holes through each strut end portion parallel to one another and to the end slots;

(b) an elastic tension-bearing cord having substantially rigid tips held facing in opposite directions within a selected one of the lateral holes at the respective strut end portions with adjoining cord portions adjacent the tips fitted through the respective adjacent end slots and with a stretched intermediate portion therebetween directed halfway around the strut, the degree of stretch being determined by the selection of lateral holes in which the cord tips are held;

(c) each end slot of the strut also fitted about the elastic cord of a like unit; and (d) a pair of removable caps force-fitted over the respective strut ends and partially enclosing the end slots.

* * * * *